US006659931B2

(12) United States Patent
Uera et al.

(10) Patent No.: US 6,659,931 B2
(45) Date of Patent: Dec. 9, 2003

(54) JAW DEVICE FOR ROTARY-PRESS FOLDING SECTION

(75) Inventors: Yoshinori Uera, Kawasaki (JP); Takeo Nanba, Yokohama (JP); Toshio Hasegawa, Kawasaki (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/103,490

(22) Filed: Mar. 21, 2002

(65) Prior Publication Data

US 2002/0193227 A1 Dec. 19, 2002

(30) Foreign Application Priority Data

Jun. 11, 2001 (JP) ..... 2001-175001

(51) Int. Cl.[7] ..... B31F 1/00

(52) U.S. Cl. ..... 493/432; 493/435; 493/437; 493/444

(58) Field of Search ..... 493/424, 428, 493/432, 434, 435, 437, 442, 444

(56) References Cited

U.S. PATENT DOCUMENTS

| | | | | |
|---|---|---|---|---|
| 3,820,774 A | | 6/1974 | Hertrich | |
| 5,494,270 A | * | 2/1996 | Laubscher | 270/49 |
| 5,522,586 A | * | 6/1996 | Bennett et al. | 270/8 |
| 6,234,947 B1 | | 5/2001 | Michalik | |

FOREIGN PATENT DOCUMENTS

| | | |
|---|---|---|
| DE | 435594 | 10/1926 |
| DE | 623219 | 12/1935 |
| FR | 1 505 567 | 11/1967 |

* cited by examiner

*Primary Examiner*—Eugene Kim
(74) *Attorney, Agent, or Firm*—McGlew and Tuttle, P.C.

(57) ABSTRACT

A jaw device for rotary-press folding section provided on a jaw cylinder in which the a continuous paper web guided in between a cutting cylinder and a folding cylinder is guided along the outer periphery of the folding cylinder, with the leading edge thereof held by a holding mechanism provided on the folding cylinder and wound around the outer periphery of the folding cylinder by the rotation of the folding cylinder, cut to a predetermined length with a cutting mechanism; the cut paper sheet being guided to an appropriate position along the outer periphery of the folding cylinder; the leading edge of the cut sheet being released from the held state and caused to protrude into the jaw cylinder with an insertion blade, thereby the cut sheet being folded by gripping the insertion blade and the cut sheet caused to protrude by the insertion blade; the folding section jaw device comprising an opening provided on the outer periphery of the jaw cylinder in parallel with the axial line, and a jaw proper comprising a jaw made of a thin elastic material provided on the inner wall end of the opening and a movable plate made of a thin elastic material.

6 Claims, 5 Drawing Sheets

JAW DEVICE FOR ROTARY-PRESS FOLDING SECTION

CROSS REFERENCE TO RELATED APPLICATIONS

This application claims priority from Japanese patent application Serial no. 2001-175001 filed Jun. 11, 2001, the contents of which are incorporated by reference herein.

BACKGROUND OF THE INVENTION

1. Field of the Invention

The present invention relates to a jaw device for a jaw cylinder provided on the rotary-press folding section that ensures high printing quality by eliminating setoff on the printing surface and contamination on the paper, and preventing signatures, or folded sheets, from coming off from the jaw device.

2. Description of the Related Art

A jaw device for a folding section of a rotary press where a guided continuous paper web is cut to an appropriate length while being wound on the outer periphery of a folding cylinder, and the cut paper sheet guided along the outer periphery of the folding cylinder is caused to protrude into a jaw cylinder provided in contiguity with the folding cylinder by an insertion blade provided on the folding section, and the cut sheet is folded in parallel with the centerline of the folding section by gripping the insertion blade and the paper caused to protrude by the insertion blade is publicly known, as disclosed in Japanese Published Unexamined Patent Application No. Sho-54(1979)-63904 and Japanese Published Unexamined Utility Model Application No. Sho-60(1985)-193365.

Japanese Published Unexamined Patent Application No. Sho-54(1979)-63904 discloses a jaw device comprising a fixed jaw provided on the leading-end side wall edge in the rotational direction on an opening on the outer periphery of the jaw cylinder that is disposed at a location facing an insertion blade of the folding cylinder in the neighborhood thereof, a movable plate that is provided facing the fixed jaw in the opening in such a manner as to be movable between a position at which the paper is gripped and a position at which the paper is not griped so that the paper caused to protrude by the insertion blade can be gripped between the movable plate and the fixed jaw, and a strip made of a rubber elastic material that is provided protruded from a surface of the movable plate on which the paper caused to protrude by the insertion blade and the insertion blade is gripped so that the paper is gripped between the strip and the fixed jaw (herein after referred to as a "first prior art.")

In the full-text specification of Japanese Unexamined Published Utility Model Application No. Sho-60(1985)-193365, a jaw device comprising a fixed jaw provided at the tip of the rear-side wall in the rotational direction in the opening on the outer periphery of the jaw cylinder that is disposed facing the folding-cylinder insertion blade in the neighborhood thereof, and a movable plate made of a flat plate that is provided facing the fixed jaw in the opening in such a manner as to be movable between a position at which the paper is gripped and a position at which the paper is not gripped so that the paper caused to protrude by the insertion blade can be gripped between the movable plate and the fixed jaw is disclosed (hereinafter referred to as a "second prior art.")

Furthermore, the full-text specification of Japanese Unexamined Published Utility Model Application No. Sho-60

(1985)-193365 discloses a jaw device comprising gripping means having a fixed jaw as shown in the second prior art and a movable plate made of a flat plate, a pin provided passing through the movable plate and facing the fixed jaw for forcing the paper caused to protrude by an insertion blade onto the fixed jaw, in addition to the movable plate, and a leaf spring for transmitting a pushing force to the pin; the insertion blade notched at a position facing the pin (hereinafter referred to as a "third prior art.")

The jaw device, on the other hand, usually has a recoiling member, such as a spring, on a support member on the side of the movable plate so as to allow for differences in the thickness of the paper gripped by the fixed jaw and the movable plate, and eliminate the loosening of the grip caused by pulling the insertion blade off the jaw device.

In the aforementioned prior-art techniques, the continuous paper web guided by the outer periphery of the folding cylinder in such a manner that the leading end of the web is held by a holding mechanism provided on the folding cylinder, and guided along the outer periphery of the folding cylinder while being wound around the outer periphery of the folding cylinder. Next, the web is cut to predetermined lengths by a cutting mechanism. The cut sheet is then guided along the outer periphery of the folding cylinder, and caused to protrude toward the inside of the jaw cylinder by the insertion blade provided on the folding cylinder while the leading end of the web is released from the held state at an appropriate position.

The protruded insertion blade and the paper are gripped by the fixed jaw and the movable plate in the opening of the jaw cylinder facing the insertion blade.

At this time, the strip made of an elastic material provided on the paper-gripping side surface of the movable plate, in the first prior art, keeps forcing the paper in between the insertion blade and the strip as the strip is compressed by the angular displacement of the movable plate.

Next, the insertion blade of the folding cylinder is extracted from between the fixed jaw and the movable plate, and the cut sheet is folded in parallel with the centerline of the folding cylinder.

When the insertion blade is extracted, a gap is produced between the paper caused to protrude by the insertion blade and located on both sides of the insertion blade. This gap is closed by the repulsive force of the elastic material strip that is compressed to hold down the paper as well as by the action of the repulsive member provided on the side of the movable plate, and the paper is completely gripped by the fixed jaw and the movable plate of the jaw cylinder.

In the second prior art, when the insertion blade and the paper are gripped by the fixed jaw and the movable plate and then the insertion blade is extracted, a gap is produced between the paper protruded by the insertion blade and located on both sides of the insertion blade. This gap is closed by the action of the repulsive member provided on the side of the movable plate, and the paper is tightly gripped by the fixed jaw and the movable plate of the jaw cylinder. Thus, the cut sheet is folded in parallel with the centerline of the folding cylinder.

In the third prior art, the fixed jaw and the movable plate grip the insertion blade and the paper on both sides of the insertion blade, and the paper between the fixed jaw and the movable plate is forced directly onto the fixed jaw with a pin by the repulsive force generated by the deflected leaf spring.

Next, when the insertion blade is extracted, a gap is produced between the paper protruded by the insertion blade and located on both sides of the insertion blade. This gap is closed by the action of the repulsive member provided on the side of the movable plate, and the paper is completely gripped by the fixed jaw and the movable plate of the jaw cylinder. The pin forcing the paper by the repulsive force of the leaf spring forces the paper onto the fixed jaw, and the cut sheet is folded in parallel with the centerline of the folding cylinder.

As described above, the paper folded by the prior-art jaw device then rotates the jaw cylinder as the paper is gripped by the jaw device of the jaw cylinder. The paper is guided along the outer periphery of the jaw cylinder with the rotation of the jaw cylinder, released from the jaw device at an appropriate position, and delivered to the discharge mechanism in the downstream side.

The aforementioned prior-art techniques have several problems to be solved. In the first, second and third prior-art techniques, when the insertion blade causes a cut sheet to protrude in between the fixed jaw and the movable plate of the jaw cylinder, the paper interposed between the fixed jaw and the insertion blade is folded while being ironed by the insertion blade and fixed jaw without finding space to escape, leading to contamination on both sides of the paper. In addition to this, the overlapped paper sheets are pressed each other, resulting in a setoff, or the transfer of printed images to the opposing printing surfaces that leads to contamination of the paper.

Furthermore, as the jaw cylinder gripping the cut and folded paper is rotated and the cut and folded paper is guided along the outer periphery of the jaw cylinder with the rotation of the jaw cylinder, the paper moves along with one end folded and gripped and the other free end being trailed toward the upstream in the rotational direction of the jaw cylinder. Thus, a force in the opposite direction to the rotational direction of the jaw cylinder acts upon the jaw proper.

In the first prior-art technique, this force tends to separate the movable plate away from the fixed jaw, resisting the force of the repulsive member provided on the movable plate side, causing a gap between the fixed jaw and the gripped paper. In the second prior-art technique, an end of the folded and gripped paper acts like a lever with the fixed jaw as a fulcrum to prize open the movable plate in the direction away from the fixed jaw resisting the force of a repulsive member provided on the movable plate side. Thus, a coming off of paper could result in both the prior-art techniques.

In addition, when the fixed jaw and the flat movable plate grip the insertion blade and the paper, as in the second prior-art technique, there is nothing to resist the slip of paper on both the fixed jaw and the flat movable plate. As a result, the paper may be pulled out of the jaw cylinder, together with the insertion blade, leading to disruption in paper folding operation.

SUMMARY OF THE INVENTION

It is an object of the present invention to provide a jaw device for a rotary-press folding section which eliminates the contamination of paper surfaces caused when an insertion blade causes a paper web being cut to protrude in between a fixed jaw and a movable plate It is another object of the present invention to provide a jaw device for rotary-press folding section which prevents paper from being disrupted when the insertion blade extracts the paper from the jaw device, and from coming off when a jaw cylinder gripping the folded paper is rotated to guide the paper to the succeeding process.

In the disclosed embodiments, there is provided on a jaw cylinder a jaw device in which a cutting cylinder, a folding cylinder and a jaw cylinder a provided in parallel with each other in a folding section of a rotary press, a continuous paper web guided in between the cutting cylinder and the folding cylinder is further guided along the outer periphery of the folding cylinder, with the leading end thereof held by a holding mechanism provided on the folding cylinder and wound around the outer periphery of the folding cylinder by the rotation of the folding cylinder, and cut into a predetermined length by the collaboration of a cutting mechanism provided on the cutting cylinder and the folding cylinder, the cut paper sheet being guided to an appropriate position along the outer periphery of the folding cylinder, with the leading end of the cut paper sheet released from the held state and caused to protrude into the jaw cylinder by an insertion blade of an insertion blade mechanism provided on the folding cylinder, both the insertion blade and the paper caused to protrude by the insertion blade being gripped, and the cut paper sheet being folded in parallel with the centerline of the folding cylinder; the jaw device having such a construction that the jaw device comprises at least one opening provided in parallel with the axial line on the outer periphery of the jaw cylinder facing in close vicinity of the insertion blade of the folding cylinder, a jaw provided in parallel with the opening and comprising at least one thin plate made of an elastic material, and gripping means comprising a movable plate made of a thin elastic material provided in parallel with the jaw that can move the insertion blade and the paper caused to protrude by the insertion blade from a position at which the paper is gripped to a position at which the paper is not gripped, so that the insertion blade of the folding cylinder and the paper caused to protrude into the cylinder by the insertion blade can be gripped by the jaw made of a thin elastic material and folded.

A slip stopper made of a material having a large friction coefficient is provided on any one or both of the surface of the movable plate of the gripping means at which the paper is gripped, and the surface of the jaw at which the paper is gripped.

DETAILED DESCRIPTION OF PREFERRED EMBODIMENTS

Figure 1:
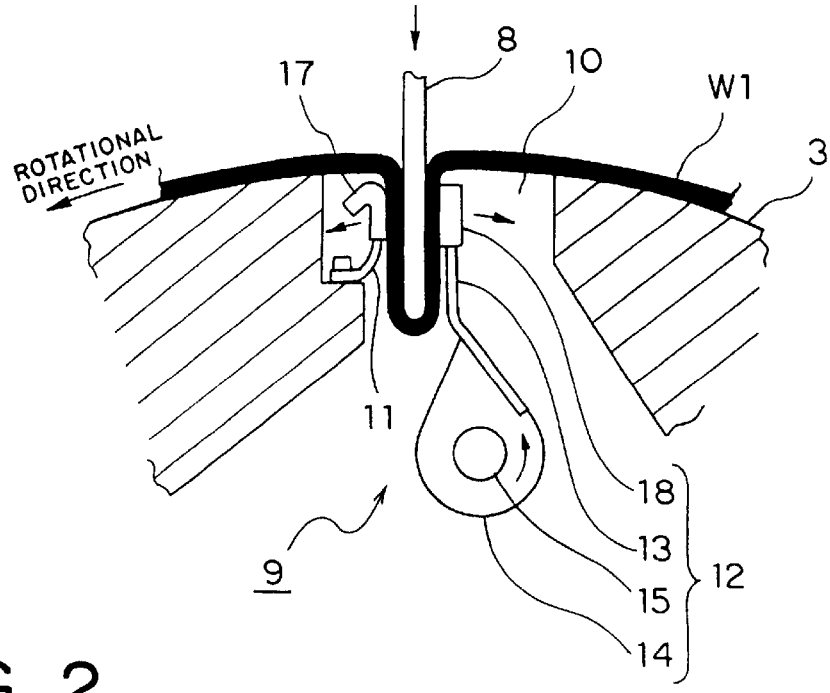
FIG. 1 is a partial schematic cross-sectional view of the jaw device according to the present invention showing the state where the insertion blade is inserted.

A folding section of a rotary press to which an embodiment of the present invention is applied comprises a cutting cylinder 1, a folding cylinder 2 and a jaw cylinder 3, all of which are provided in parallel with each other, and whose outer peripheral surfaces facing each other are caused to rotate in synchronism in the same direction.

On the cutting cylinder 1 provided are saw blades 5 constituting a cutting mechanism 6, together with a saw blade receptacles 4 provided on the folding cylinder 2, which will be described later, at positions 180 degrees apart on the outer periphery thereof.

On the folding cylinder 2 provided are the saw blade receptacles 4 constituting the cutting mechanism 6, together with the saw blades 5, at five equally spaced positions on the outer periphery, and at equal intervals to those of the saw blades 5 of the cutting cylinder 1, and a plurality of needles 7 as a holding mechanism are provided in the vicinity of the upstream side of the saw blade receptacles 4 in the rotational direction of the folding cylinder 2. Furthermore, insertion blades 8 of the insertion blade mechanism are provided in the middle of the saw blade receptacles 4 and at five equally spaced positions on the outer periphery.

The folding cylinder 2 is disposed between the cutting cylinder 1 and the jaw cylinder 3 in such a manner that the outer periphery thereof comes close to and faces not only the outer periphery of the cutting cylinder 1 but also the outer periphery of the jaw cylinder 3. The saw blade 5 of the cutting cylinder 1 and the saw blade receptacle 4 of the folding cylinder 2 face in close vicinity of each other on the outer periphery of their respective cylinders, and the insertion blade 8 of the insertion blade mechanism of the folding cylinder 2 and the jaw device 9 according to the present invention of the jaw cylinder 3 face in close vicinity of each other on the outer periphery of their respective cylinders in such a manner as to rotate in synchronism with each other in the same rotational direction of their respective facing surfaces.

Figure 2:
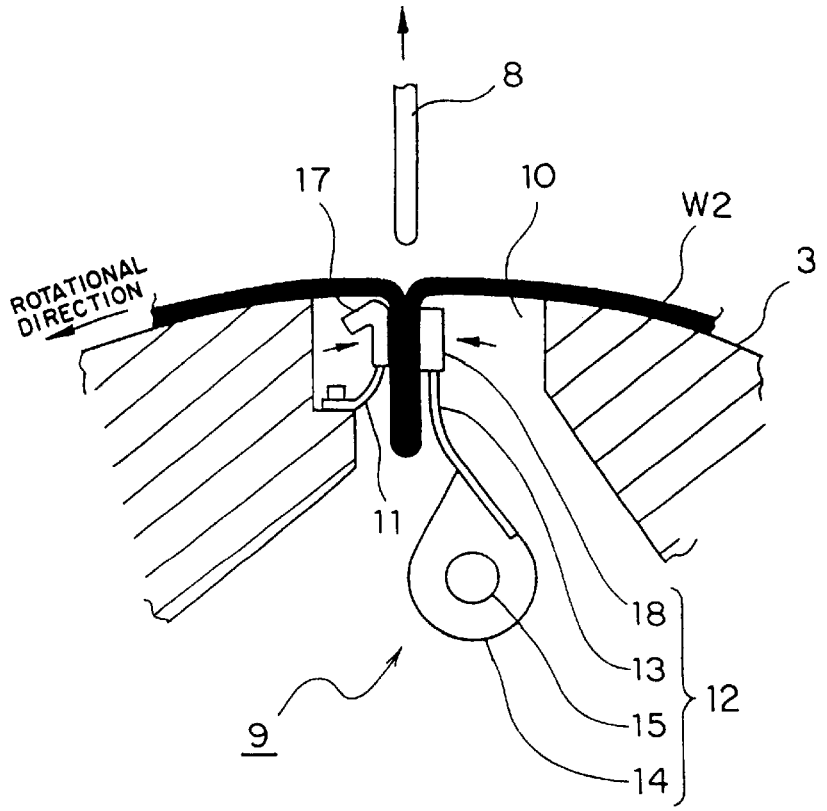
FIG. 2 is a partial schematic cross-sectional view of the jaw device according to the present invention showing the state where the insertion blade is extracted.

The jaw device 9 according to the present invention provided on the jaw cylinder 3 comprises an opening 10 on the outer periphery of the jaw cylinder 3, a jaw 11 and a jaw proper 12, as shown in FIGS. 1 and 2.

(1) Opening 10

The opening 10 is an opening provided in parallel with the axial line of the jaw cylinder 3 in the same number as that of the insertion blade 8 in the embodiment shown in the figures and disposed on the outer peripheral surface of the jaw cylinder 3 and face in close vicinity of the insertion blade 8 of the insertion blade mechanism of the folding cylinder 2 as both the cylinders rotates. The opening 10 houses a jaw 11, which will be described later, and a jaw proper 12.

(2) Jaw 11

The jaw 11 comprises a leaf spring which is shaped as a letter "j" at its working end which contacts the paper, made of a thin elastic material strip having a surface parallel with the radial direction of the jaw cylinder 3 that is provided at the leading-end wall of the opening 10 in the rotational direction of the jaw cylinder 3, extending continuously in the across-the-width direction of the paper parallel with the opening 10 in such a manner that the jaw 11 can grip, in collaboration with the movable plate 13, which will be described later, the insertion blade 8 caused to protrude into the opening 10 of the jaw cylinder 3 by the insertion blade mechanism provided on the folding cylinder 2, which will be described later, and the paper caused to protrude by the insertion blade 8 at a location where the jaw cylinder 3 faces in close vicinity of the outer periphery of the folding cylinder 2.

(3) Jaw Proper 12

The jaw proper 12 comprises a movable plate 13 for gripping the insertion blade 8 and the paper caused to protrude by the insertion blade 8 in collaboration with the jaw 11, a bracket 14 for fixedly fitting the base of the movable plate 13, and a drive and transmission shaft 15 to which the bracket 14 is attached for causing the movable plate 13 to move between a position at which the paper is gripped in collaboration with the jaw 11 and a position at which the paper is not gripped.

The movable plate 13 comprises a leaf spring made of a thin elastic material strip extending continuously in the across-the-width direction of the paper that is disposed facing and in parallel with the jaw 11. On the surface of the movable plate 13 coming in contact with the paper provided is a slip stopper 18 made of a material having a high friction coefficient, such as hard rubber.

The bracket 14 extends in the across-the-width direction of the paper and is provided in parallel with the movable plate 13 to fixedly fit an end of the movable plate 13 on the side of the center of the jaw cylinder 3.

The drive and transmission shaft 15 having the bracket 14 in the middle thereof is rotatably supported by bearings provided on both ends thereof in the opening 10 of the jaw cylinder 3, extending in parallel with the axial line of the jaw cylinder 3. The drive and transmission shaft 15 can make an angular movement as a roller provided via an arm mounted on an end protruding from the side surface of the jaw cylinder 3 is guided by a fixed cam provided on the side surface of the jaw cylinder 3.

The movable plate 13 and the bracket 14 may be provided in pieces by appropriately dividing in the across-the-width direction of the paper. It would be more effective in gripping the paper, however, to match the movable plate 13 to the length of the jaw 11.

The operation of the jaw device of the folding section according to the present invention having the aforementioned construction will be described in the following.

In the aforementioned construction, as the folding section 16 is operated, the cutting cylinder 1, the folding cylinder 2 and the jaw cylinder 3 rotate (as to the rotational direction, refer to the arrow in FIG. 3) in synchronism with each other, as described earlier.

The paper web W is fed by the operation of upstream equipment (not shown) to a position at which the outer periphery of the cutting cylinder 1 faces in close vicinity of the outer periphery of the folding cylinder. The paper web is held at multiple locations in the across-the-width direction of the paper as needles 7 protruding from the outer periphery of the folding cylinder 2 pierce the web W, and the web W is cut off as the saw blade 5 bites into the saw blade receptacle 4 on the immediate downstream side of the position at which the paper is held.

A leading part of the web W held by the needles 7 is passed through a position at which the outer periphery of the cutting cylinder 1 faces in close vicinity of the outer periphery of the folding cylinder 2 by the rotation of the folding cylinder 2, and guided while being wound around the folding cylinder 2. As the folding cylinder 2 makes one-fifth of a turn, the part of the paper passing through the position at which the outer periphery of the cutting cylinder 1 faces in close vicinity of the outer periphery of the folding cylinder 2 is pierced again by the needles 7 protruding from the outer periphery of the folding cylinder 2, held at a plurality of point in the across-the-width direction, and cut as the saw blade 5 of the cutting cylinder 1 bites into the saw blade receptacle 4 on the immediate downstream side of the position at which the paper is held. Thus, the leading part of the paper is formed as a cut sheet W1 (refer to FIG. 3). After that, the aforementioned holding and cutting operation of the paper web W is repeated at the position at which the outer periphery of the cutting cylinder 1 faces in close vicinity of the outer periphery of the folding cylinder 2.

The part of the cut sheet W1 held by the needle 7 of the folding cylinder 2 is passed through the position at which the outer periphery of the folding cylinder 2 faces in close vicinity of the outer periphery of the jaw cylinder 3 in accordance with the rotation of the folding cylinder 2. Then, as the central part of the cut sheet W1 in the longitudinal direction reaches the position at which the outer periphery of the folding cylinder 2 faces in close vicinity of the outer periphery of the jaw cylinder 3 and the insertion blade 8 faces the jaw device 9 of the jaw cylinder 3 via the cut sheet W1, as shown in FIG. 4(*a*), the needle 7 retracts from the outer periphery surface of the folding cylinder 2 into the inside, thereby releasing the cut sheet W1 from the held state.

Figure 4A:
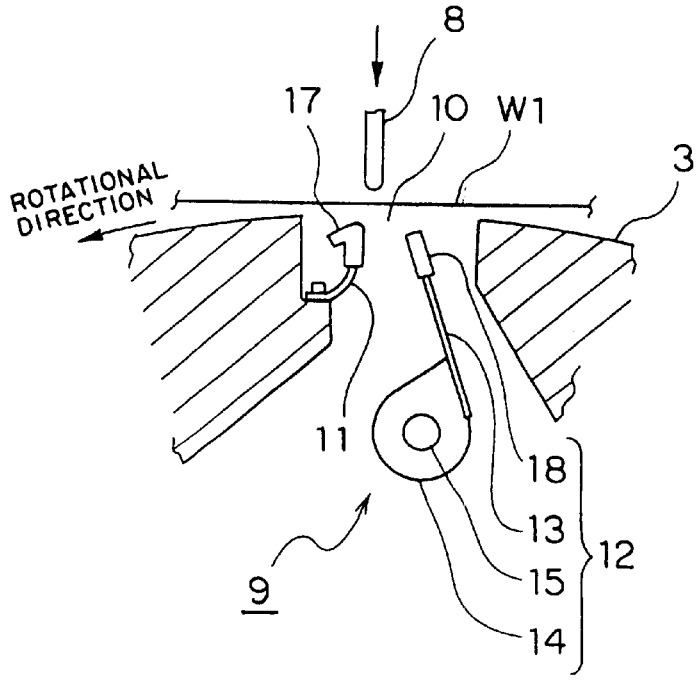
FIG. 4 is a schematic view of assistance in explaining paper folding operation by the jaw device according to the present invention.
Figure 4B:
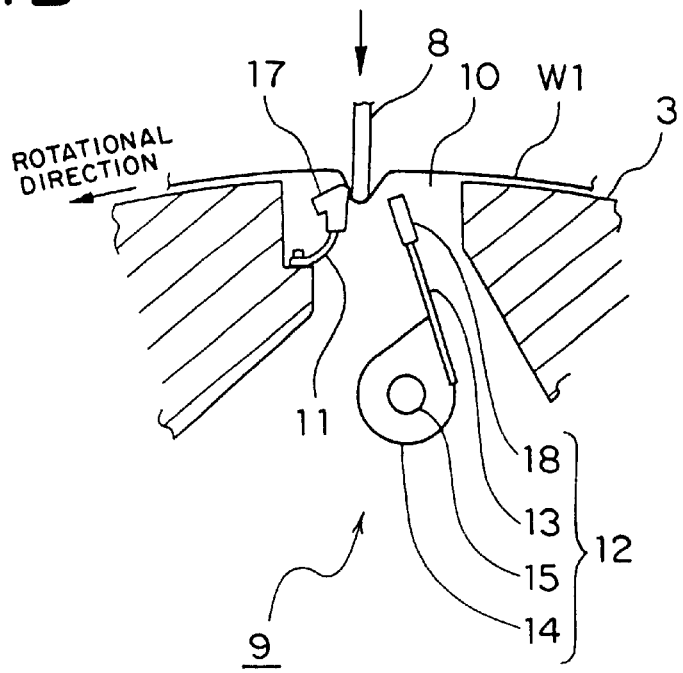

As shown in FIG. 4(*b*), the insertion blade 8 protrudes outward from the outer periphery of the folding cylinder 2, causing the almost central part of the cut sheet W1 to protrude and advance into the gap between the jaw 11 and the movable plate 13 of the jaw device 9.

When the almost central part of the cut sheet W1 is put into the gap between the jaw 11 and the movable plate 13 of the jaw cylinder 3 by the insertion blade 8, the movable plate 13 forces the protruded insertion blade 8, together with the paper on both sides thereof, onto the jaw 11, as shown in FIG. 1. That is, when the almost central part of the cut sheet W1 is put into the gap between the jaw 11 and the movable plate 13 of the jaw device 9 the jaw device 9 of the jaw cylinder 3 by the insertion blade 8 of the insertion blade mechanism, the drive and transmission shaft 15 makes an angular movement in the direction shown by an arrow by the action of the fixed cam, causing the movable plate 13 to move toward the jaw 11 to close the jaw proper 12, gripping the insertion blade 8 and the cut sheet W1 protruded by the insertion blade 8 in a state where the jaw 11 and the movable plate 13 are elastically deformed, as shown in FIG. 5(*a*).

Figure 5A:
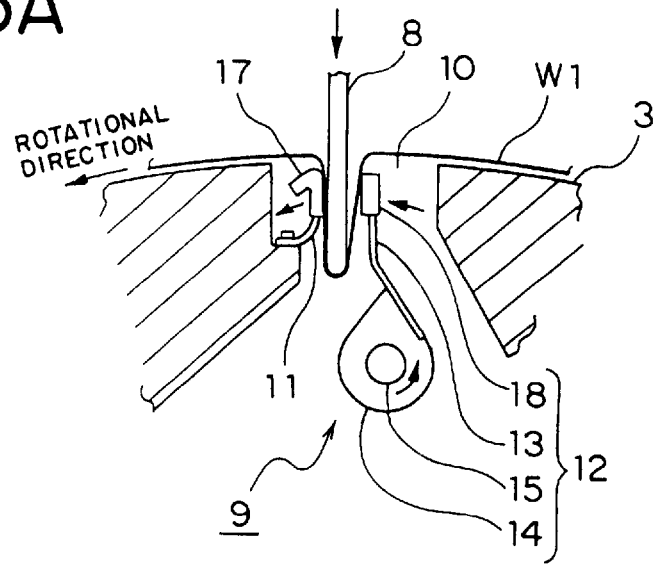
FIG. 5 is a schematic view of assistance in explaining paper folding operation by the jaw device according to the present invention.
Figure 5B:
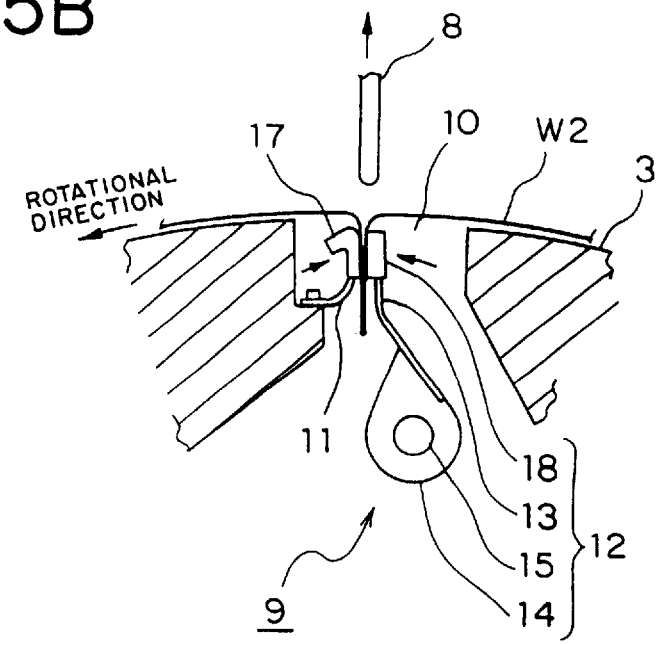

Next, as the insertion blade 8 of the folding cylinder 2 is extracted from the cut sheet W1, the jaw 11 and the movable plate 13 slightly undo the elastic deformation to tightly grip only the cut sheet W1, as shown in FIG. 5(*b*). Thus, the cut sheet W1 is folded in parallel to the centerline of the folding cylinder 2 to from a signature W2.

In the aforementioned operation, when the insertion blade 8 causes the cut sheet W1 to enter into the gap between the jaw 11 and the movable plate 13 of the jaw cylinder 3, the pushing force in the through-thickness direction of the insertion blade 8 is exerted onto the cut sheet W1 between the insertion blade 8 and the jaw 11. This pushing force is applied to the jaw 11 outside the paper.

However, the jaw 11 which is made of a leaf spring is bent outward due to its elastic deformation, giving an escape to the paper about to be folded, thus reducing the pushing force to a force caused by the bent leaf spring. As a result, no excessive force is exerted onto the adjoining printed surfaces to cause contamination on them due to setoff.

When the insertion blade 8 is extracted, separating from the cut sheet W1 about to be folded, as shown in FIG. 2, an appropriate degree of the pushing force by the jaw 11 and the movable plate 13 and the resistance of the slip stoppers 17 and 18 provided on the paper contact surface of the jaw 11 and the movable plate 13 prevent the cut sheet W1 about to be folded from being taken out of the outer periphery of the jaw cylinder, together with the insertion blade 8, thus causing the cut sheet W1 to be folded with the paper edge in alignment.

After the insertion blade 8 has been extracted, both the jaw 11 and the movable plate 13 slightly undo the deflection due to elastic deformation, and grip the signature W2 of the cut sheet W1 that has been folded with an appropriate force.

Figure 3:
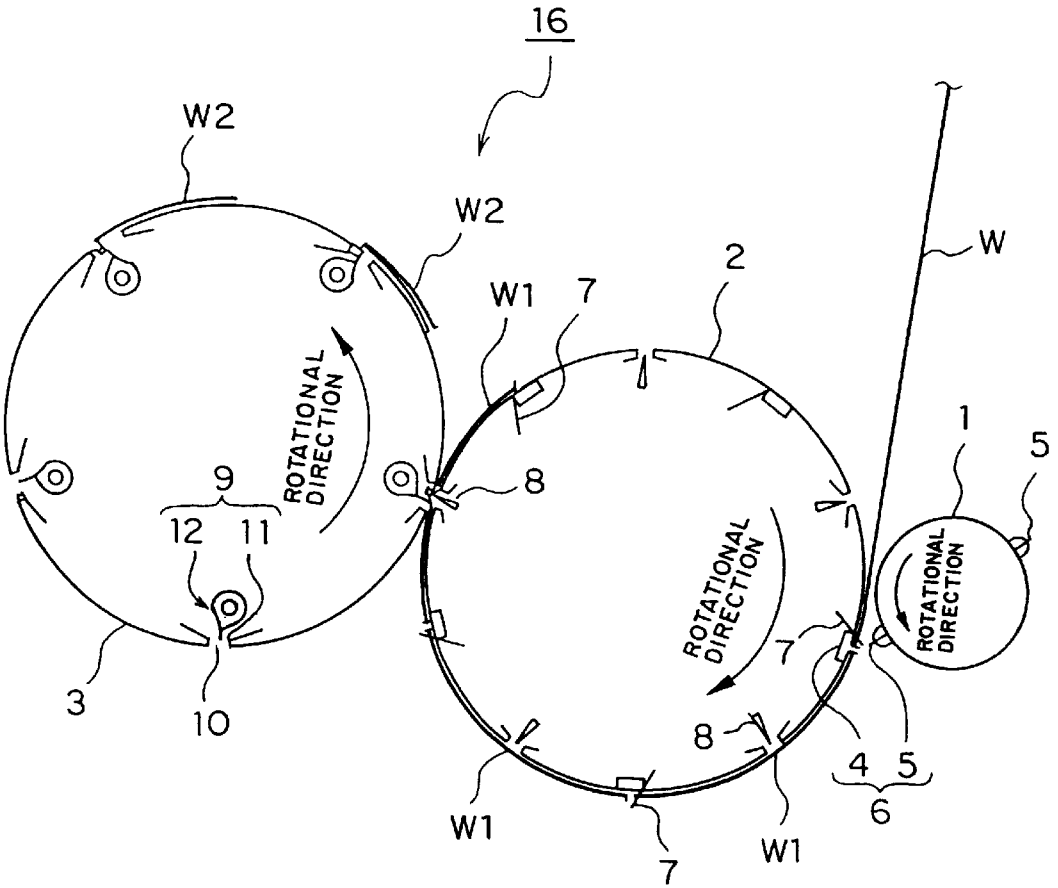
FIG. 3 is a schematic diagram of a folding section to which an embodiment of the present invention is applied.
Figure 6:
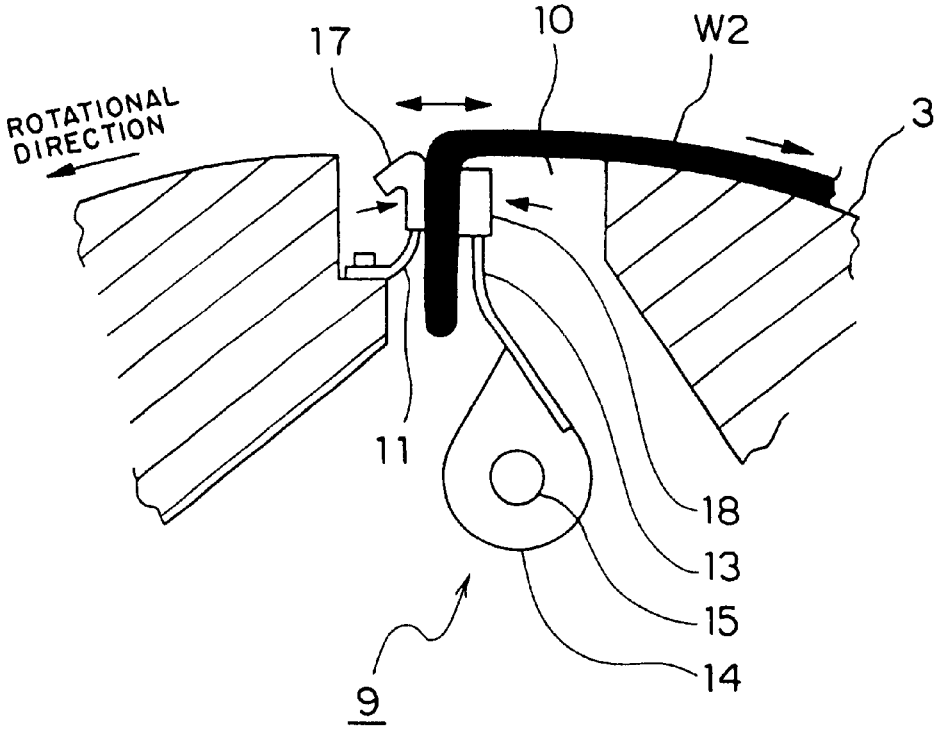
FIG. 6 is a partial schematic cross-sectional view of the jaw device according to the present invention showing the state where a signature is guided along the outer periphery of the jaw cylinder.

Next, the jaw device 9 grips the signature W2, and the signature W2 is guided along the outer periphery of the jaw cylinder 3 along with the rotation of the jaw cylinder 3, as shown in FIGS. 3 and 6.

At this time, the jaw device 9 moves along the outer periphery of the jaw cylinder 3 while gripping an end of the signature W2, with the free end thereof trailing toward the upstream of the rotational direction of the jaw cylinder 3. As a result, a force toward the upstream side in the rotational direction of the jaw cylinder 3, that is, a force in the direction opposite to the rotational direction is exerted onto the jaw device 9 via the signature W2 to separate the movable plate 13 away from the jaw 11.

The signature W2, however, is always kept gripped by an appropriate degree of pushing force from both sides, being prevented from coming off since both ends of the signature W2 are gripped from both sides by the jaw 11 made of a leaf spring and the movable plate 13 in the bent state due to elastic deformation. Even if the movable plate 13 is bent in the opposite direction to the gripping direction, the jaw 11 acts to follow the deflection of the movable plate 13, preventing the jaw 11 and the movable plate 13 from separating from each other.

After the signature W2 is guided along the outer peripheral surface of the jaw cylinder 3, the jaw cylinder 3 rotates about three fifths of a turn from the position at which the jaw cylinder 3 faces in close vicinity of the folding cylinder 2, that is, the gripping position, and the movable plate 13 moves in the direction away from the jaw 11, opening the jaw proper 12 to deliver the signature W2 to a discharge mechanism on the downstream side.

In this way, operations by the folding cylinder 2 and the jaw cylinder 3 are continuously carried out following the continuous operations by the cutting cylinder 1 and the folding cylinder 2 to complete paper folding operations.

In the foregoing, description has been made about an embodiment where the jaw 11 of the jaw device 9 is provided at the tip of the leading side wall of the opening 10 in the rotational direction of the jaw cylinder 3, but the jaw 11 may be provided at the tip of the trailing side wall of the opening 10 in the rotational direction of the jaw cylinder 3.

The folding cylinder 2 described above has the cutting cylinder 1, the folding cylinder 2 and the jaw cylinder 3 in the diameter ratio of about 2 to 5 to 5, but the diameter ratio of these cylinders is not limited to the above ratio.

As described above, the present invention makes it possible to eliminate offset on printed surfaces and contamination of paper surfaces, maintaining printing quality because the paper is prevented from being unwantedly ironed out as the pushing force onto the paper is relieved due to the elastic deformation of the jaw in response to the through-thickness force of the insertion blade when the insertion blade in protruded in between the jaw and the movable plate by using a thin elastic material strip in making the jaw and the movable plate of the jaw device on the jaw cylinder, gripping both sides of the cut sheet guided from the folding cylinder for subsequent folding.

Furthermore, the present invention makes it possible to keep a signature gripped by the jaw and the movable plate with an appropriate force, preventing the signature from coming off from the jaw device because no gap is formed between the contact surfaces of the jaw and the movable plate since the jaw follows the deflection of the movable plate even when a force is exerted in the direction opposite to the rotational direction of the jaw cylinder as the signature is moved along the outer periphery of the jaw cylinder with one end of the signature gripped and the other free end thereof trailed toward the upstream side in the rotational direction of the jaw cylinder by using a thin elastic material strip for the jaw and the movable plate of the jaw device of the jaw cylinder, and gripping both side ends of a folded signature and guiding the signature along the outer periphery of the jaw cylinder. When the jaw is provided on the trailing end of the opening in the rotational direction of the jaw cylinder, the same effect can be achieved because no gap is formed between the contact surfaces of the jaw and the movable plate since the movable plate follows the deflection of the jaw even when the jaw is bent due to a force exerted in the direction opposite to the rotational direction of the jaw cylinder.

In addition, the invention disclosed in claim 2 makes it possible to easily fold the paper with the edges thereof in alignment since the disturbance in the paper caused by the drawing of the gripped paper together with the insertion blade when extracting the insertion blade from the jaw device can be prevented by providing a slip stopper on the paper contact surfaces of both or either of the jaw and the movable plate.

What is claimed is:

1. A jaw device for a rotary-press folding section having a cutting cylinder, a folding cylinder and a jaw cylinder, all in parallel with each other, so that a continuous paper web guided in between the cutting cylinder and the folding cylinder is guided along the outer peripheral surface of the folding cylinder while winding around the outer peripheral surface of the folding cylinder by the rotation of the folding cylinder, with the leading end thereof held by a holding mechanism provided on the folding cylinder, and cut into a predetermined length through the collaboration of a cutting mechanism provided on the cutting cylinder and the folding cylinder, the cut paper sheet being guided to an appropriate position along the outer peripheral surface of the folding cylinder, then the leading end of the cut paper sheet being released from the held state and caused to protrude into the jaw cylinder by an insertion blade of an insertion blade mechanism provided on the folding cylinder, and then the insertion blade and the paper caused to protrude by the insertion blade being gripped to fold the cut sheet in parallel with the centerline of the folding cylinder; the improvement comprising;

at least one opening provided in parallel with the axial line on the outer peripheral surface of the jaw cylinder that faces in close vicinity of the insertion blade of the folding cylinder as both the cylinders rotate;

a gripping mechanism provided in the opening for elastically holding the insertion blade of the folding cylinder and the paper caused to protrude in the jaw cylinder by the insertion blade from both sides thereof, and when the folding cylinder insertion blade is extracted from the jaw cylinder, elastically keeping the paper sandwiched in the jaw cylinder for subsequent folding, the gripping mechanism comprising a first jaw part with a working end for contacting the paper, the first part being shaped as the character "J", made of at least a thin elastic bendable material mounted on an end of the inside wall of the opening in parallel with the opening, and another jaw part having a movable plate made of at least a thin elastic material provided facing in parallel with the first jaw part in such a manner that the movable plate can be moved between a position at which the insertion blade and the paper caused to protrude by the insertion blade are gripped in collaboration with the bending first jaw part and a position at which the insertion blade and the paper caused to protrude by the insertion blade are not gripped; so that the insertion blade of the folding cylinder and the paper caused to protrude in the jaw cylinder by the insertion blade are gripped by the first jaw and the movable plate, both made of a thin elastic material, and the paper is folded; and slip stoppers made of a material having a high friction coefficient are provided on both or any one of the paper-gripping surface of the another jaw part movable plate and the paper-gripping surface of the first jaw part.

2. A jaw device for a rotary-press folding section as set forth in claim 1 wherein the another jaw part comprises the movable plate for gripping the insertion blade and the paper caused to protrude by the insertion blade in collaboration with the first jaw part, a bracket for fixedly fitting the base of the movable plate, and a drive and transmission shaft for moving the movable plate via the bracket between a position at which the movable plate grips the paper in collaboration with the first jaw part and a position at which the movable plate does not grip the paper.

3. A jaw device for a rotary-press folding section having a cutting cylinder, a folding cylinder and a jaw cylinder, all in parallel with each other, so that a continuous paper web guided in between the cutting cylinder and the folding cylinder is guided along the outer peripheral surface of the folding cylinder while winding around the outer peripheral surface of the folding cylinder by the rotation of the folding cylinder, with the leading end thereof held by a holding mechanism provided on the folding cylinder, and cut into a predetermined length through the collaboration of a cutting mechanism provided on the cutting cylinder and the folding cylinder, the cut paper sheet being guided to an appropriate position along the outer peripheral surface of the folding cylinder, the folding cylinder having an insertion blade mechanism with an insertion blade, the jaw device comprising:

at least one opening provided in parallel with the axial line on the outer peripheral surface of the jaw cylinder facing the insertion blade of the folding cylinder as both the cylinders rotate;

a gripping mechanism Provided in the opening for elastically holding the paper caused to protrude in the jaw cylinder by the insertion blade and elastically keeping the paper sandwiched in the jaw cylinder for subsequent folding when the folding cylinder insertion blade is extracted from the jaw cylinder, the gripping mechanism comprising a first jaw part having a j-shaped portion of resilient material with a working end and a support end mounted on an inside wall of the opening and a second jaw part with a working end, said second jaw part having a movable plate made of resilient material provided facing in parallel with the first jaw part in such a manner that the movable plate can be moved between a position at which the insertion blade and the paper caused to protrude by the insertion blade are gripped in collaboration with the first jaw part and a position at which the insertion blade and the paper caused to protrude by the insertion blade are not gripped, said j-shaped portion bending by the force of the insertion blade and the leading end of the cut paper sheet being caused to protrude into the jaw cylinder and with the cut sheet being gripped to fold the cut sheet in parallel with the centerline of the folding cylinder and said j-shaped portion returning to an initial position and applying pressure to the gripped cut sheet during withdrawal of the insertion blade;

a slip stopper provided on the working end of the first jaw part; and a slip stopper provided on the working end of the second jaw part.

4. A jaw device for a rotary-press folding section as set forth in claim 3, wherein the second jaw part further comprises a bracket for fixedly fitting the base of the movable plate, and a drive and transmission shaft for moving the movable plate via the bracket between the position at which the movable plate grips the paper in collaboration with the first jaw part and the position at which the movable plate does not grip the paper.

5. A jaw device for a rotary-press folding section having a cutting cylinder, a folding cylinder and a jaw cylinder, all in parallel with each other, so that a continuous paper web guided in between the cutting cylinder and the folding cylinder is guided along the outer peripheral surface of the folding cylinder while winding around the outer peripheral surface of the folding cylinder by the rotation of the folding cylinder, with the leading end of the paper web held by a holding mechanism provided on the folding cylinder, and cut into a predetermined length through the collaboration of a cutting mechanism provided on the cutting cylinder and the folding cylinder, the cut paper sheet being guided to an appropriate position along the outer peripheral surface of the folding cylinder, the folding cylinder having an insertion blade mechanism with an insertion blade, the jaw device comprising:

at least one opening provided with an opening plane in parallel with the axial line on the outer peripheral surface of the jaw cylinder facing the insertion blade of the folding cylinder as both the cylinders rotate, a side wall of the opening having a projecting part with a surface extending in parallel to the opening plane;

a gripping mechanism provided in the opening for elastically holding the paper caused to protrude in the jaw cylinder by the insertion blade and elastically keeping the paper sandwiched in the jaw cylinder for subsequent folding when the folding cylinder insertion blade is extracted from the jaw cylinder, the gripping mechanism comprising a first jaw part of resilient material with a support end fixed to the projecting part surface and with a working end, the first jaw part having a normal position with a curved portion curving from the projecting part surface to the working end adjacent to the opening plane and a second jaw part with a working end, said second jaw part having a movable plate made of resilient material provided facing in parallel with the first jaw part in such a manner that the movable plate can be moved between a position at which the insertion blade and the paper caused to protrude by the insertion blade are gripped in collaboration with the first jaw part and a position at which the insertion blade and the paper caused to protrude by the insertion blade are not gripped, the curved portion further bending from the normal position to a deflected position by the force of the insertion blade and the leading end of the cut paper sheet being caused to protrude into the jaw cylinder and with the cut sheet being gripped to fold the cut sheet in parallel with the centerline of the folding cylinder and the curved portion returning to the normal position after withdrawal of the insertion blade and applying pressure to the gripped cut sheet moving from the deflected position to the normal position during withdrawal of the insertion blade;

a slip stopper provided on the working end of the first jaw part; and a slip stopper provided on the working end of the second jaw part.

6. A jaw device for a rotary-press folding section as set forth in claim 3, wherein the second jaw part further comprises a bracket for fixedly fitting the base of the movable plate, and a drive and transmission shaft for moving the movable plate via the bracket between the position at which the movable plate grips the paper in collaboration with the first jaw part and the position at which the movable plate does not grip the paper.

* * * * *